US005438905A

United States Patent [19]

Matheson et al.

[11] Patent Number: 5,438,905

[45] Date of Patent: Aug. 8, 1995

[54] METHOD AND APPARATUS FOR STABILIZING THE IN-TUBE TRAJECTORY OF A MISSILE

[75] Inventors: Erik R. Matheson, Sunnyvale; Jeffrey S. Wade, Mountain View, both of Calif.

[73] Assignee: Westinghouse Electric Corporation, Pittsburgh, Pa.

[21] Appl. No.: 622,297

[22] Filed: Jun. 19, 1984

[51] Int. Cl.[6] ..... F41F 3/04

[52] U.S. Cl. ..... 89/1.816; 89/1.81

[58] Field of Search ..... 89/1.816, 1.817, 1.818, 89/1.8, 1.809, 1.81

[56] References Cited

U.S. PATENT DOCUMENTS

| | | | |
|---|---|---|---|
| 3,100,421 | 8/1963 | Moy | 89/1.81 |
| 3,124,040 | 3/1964 | Fieldler | 89/1.816 |
| 3,166,978 | 1/1965 | Price et al. | 89/1.816 |
| 3,266,373 | 8/1966 | Brown | 89/1.81 X |
| 3,289,533 | 12/1966 | Brown | 89/1.81 |
| 3,857,321 | 12/1974 | Cohen | 89/1.816 X |
| 4,357,855 | 11/1982 | Merz | 89/1.816 |
| 4,399,999 | 8/1983 | Wald | 89/1.816 X |
| 4,406,211 | 9/1983 | Andersen | 89/1.816 |
| 4,433,848 | 2/1984 | Williams | 89/1.816 X |
| 4,464,972 | 8/1984 | Simon | 89/1.816 |
| 5,315,912 | 5/1994 | Huber et al. | 89/1.816 |

*Primary Examiner*—Charles T. Jordan
*Assistant Examiner*—Theresa M. Wesson

[57] ABSTRACT

Apparatus and method for bypassing eject gas around an annular seal disposed between the trailing end of a missile and a launch tube only in an area where the trailing end of the missile is close to the launch tube in order to provide a centering force on the trailing end of the missile to stabilize the in-tube trajectory of the missile during ejection.

8 Claims, 3 Drawing Sheets

METHOD AND APPARATUS FOR STABILIZING THE IN-TUBE TRAJECTORY OF A MISSILE

GOVERNMENT CONTRACT

The United States Government has rights in this invention in accordance with the terms of Contract No. N0030-81-C-0105 between Westinghouse Electric Corporation and the Department of Defense.

BACKGROUND OF THE INVENTION

This invention relates to missile launchers, and more particularly to a system for stabilizing the in-tube trajectory of a missile during launch. As the leading end of the missile leaves a launch tube, hydrodynamic forces acting near the nose result in an excursion of the trailing end of the missile in a direction opposite to the hydrodynamic forces. A hydrodynamic force on the trailing end of the missile in the same direction as the hydrodynamic forces adjacent the nose would tend to stabilize the in-tube trajectory of the missile and improve its eject characteristics.

SUMMARY OF THE INVENTION

In general, a system for stabilizing the in-tube trajectory of a missile being ejected from a launch tube by high pressure gas comprises an annular seal disposed between the missile and the launch tube adjacent the trailing end of the missile and means for bypassing the seal, the bypassing means being operable when the trailing end of the missile moves laterally toward the launch tube to only bypass high pressure gas to an area adjacent the low pressure side of the seal where the trailing end of the missile is close to the launch tube to provide a centering force adjacent the trailing end of the missile to stabilize the in-tube trajectory of the missile.

BRIEF DESCRIPTION OF THE DRAWINGS

The objects and advantages of this invention will become more apparent from reading the following detailed description in conjunction with the accompanying drawings, in which.

DESCRIPTION OF THE PREFERRED EMBODIMENT

Figure 1:
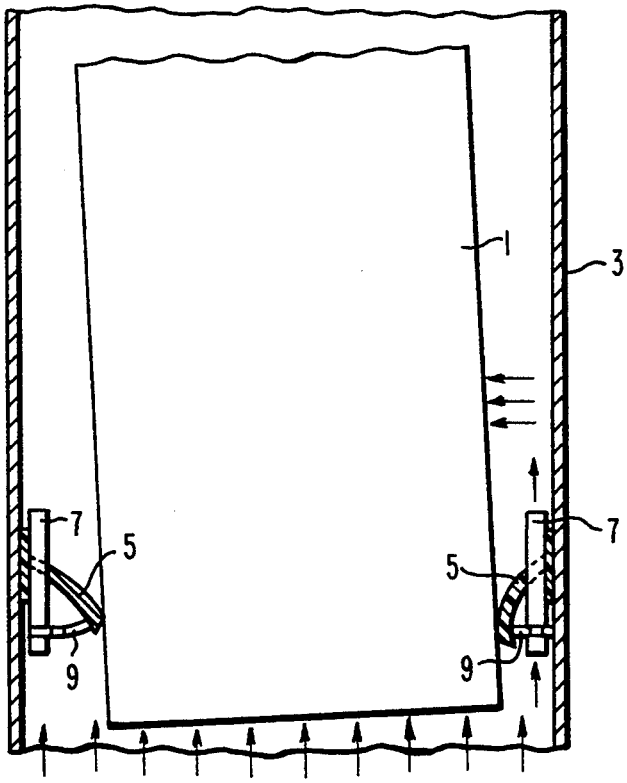
FIG. 1 is a partial sectional view of a launch tube showing a bypass around a seal.

Referring now to the drawings in detail and in particular to FIG. 1, there is shown a missile 1 being ejected from a launch tube 3 by high pressure gas. An annular seal 5 is disposed between the missile and the launch tube and the seal has a plurality of tubes 7 disposed in a circumferential array and extending through the seal. A sliding valve 9 is shown attached to the seal and tube in such a manner that when the missile is offset in the launch tube, the sliding valve 9 allows high pressure gas to bypass the seal 5 only in the area where the trailing end of the missile 1 is close to the launch tube 3 to allow the high pressure gas to create a centering force adjacent the trailing end of the missile 1 to stabilize the in-tube trajectory of the missile 1.

Figure 2:
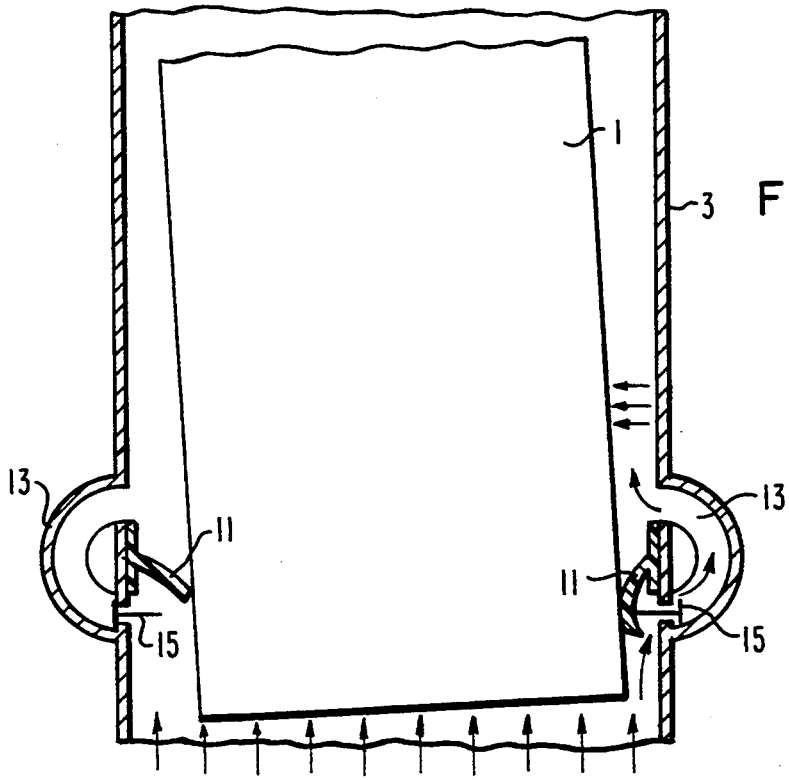
FIG. 2 is a partial sectional view of a launch tube showing an alternative bypass around a seal.

FIG. 2 shows a missile 1 being ejected from a launch tube 3 with an annular seal 11 disposed between the launch tube and the missile. A plurality of bypass conduits 13 are disposed in a circular array around the launch tube to bypass high pressure gas around the seal 11. To control the flow through the conduits 13, poppet valves 15 are disposed in the conduits 13 and are open when the trailing end of the missile 1 approaches the launch tube 3 to only bypass high pressure gas around the seal 11 in the area where the trailing end of the missile is close to the launch tube 3 to stabilize the in-tube trajectory of the missile 1.

Figure 3:
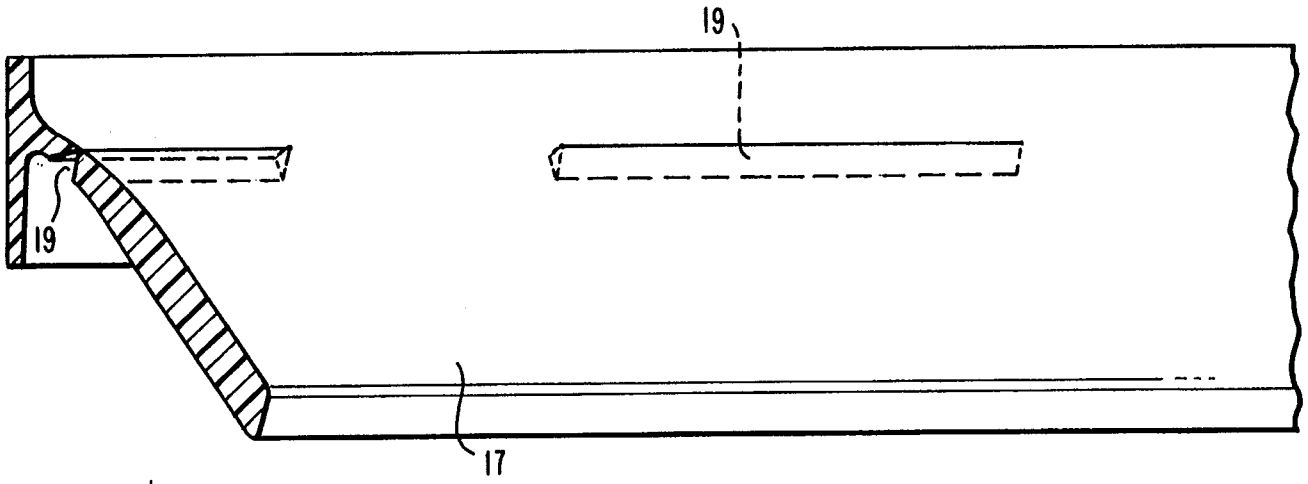
FIGS. 3 and 4 are partial sectional views of a seal with a built-in bypass.
Figure 4:
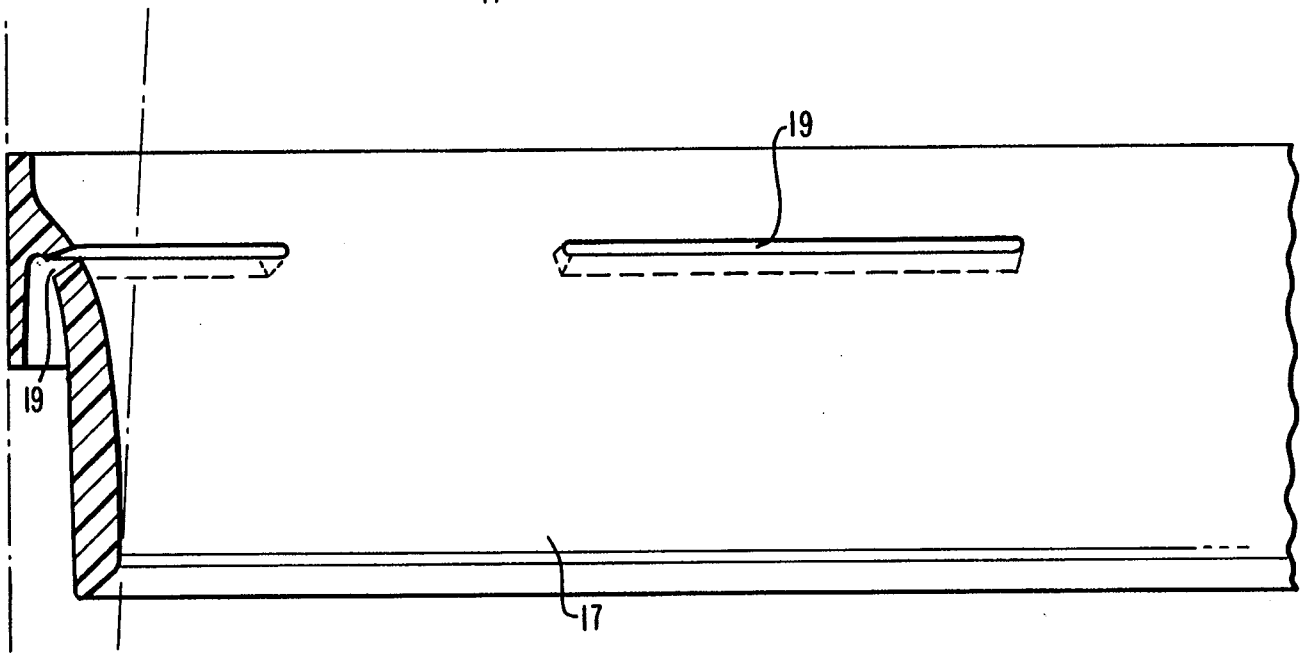

FIGS. 3 and 4 show an annular seal 17 which seals the annular gap between the missile 1 and the launch tube 3 as the missile is ejected from the launch tube by high pressure gas. The seal 17 has a plurality of circumferentially extending slots 19 disposed in a circular array adjacent the sealing surface. The slots 19 have a triangular-shaped cross section and open only when the missile is offset in the direction of the launch tube to bypass high pressure gas through the slots 19 only in the area where the missile 1 is close to the launch tube 3.

Figure 5:
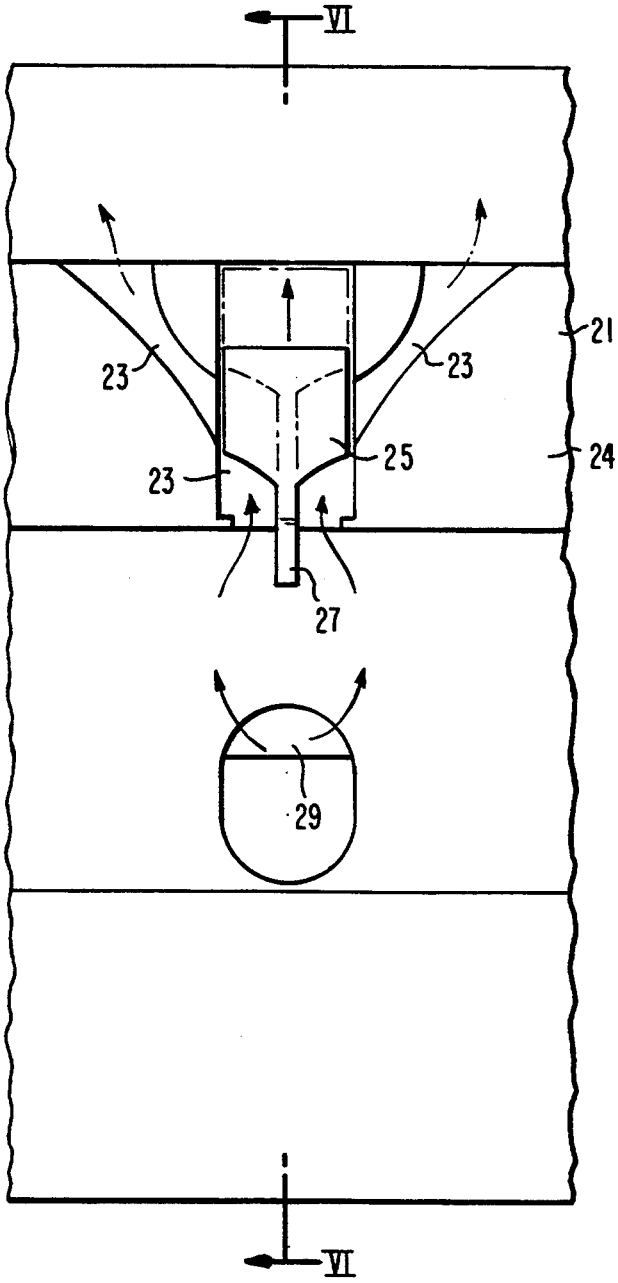
FIG. 5 is a partial sectional view of a seal with a built-in bypass.
Figure 6:
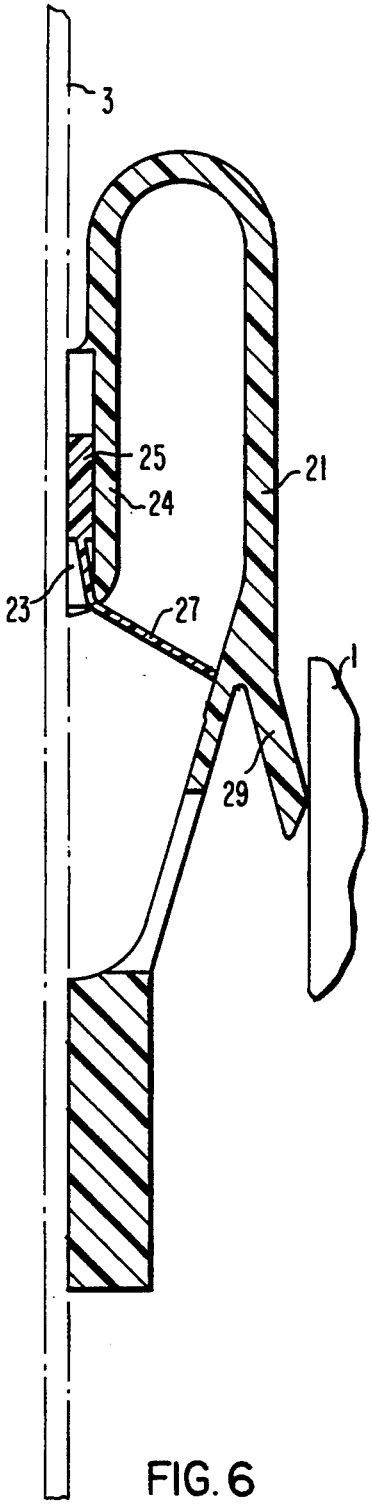
FIG. 6 is a partial sectional view taken on line VI—VI of FIG. 5.

FIGS. 5 and 6 show an annular seal 21 for sealing the annular opening between the launch tube 3 and the missile 1. The seal 21 has a Y-shaped duct 23 disposed in a base portion 24 of the seal 21 which is adhesively attached to the launch tube 3. A plug 25 is slidably disposed in a groove in the base 24 which aligns with the stem of the Y-shaped duct 23 and is disposed to close off the branches of the Y and is held in that position by a tension tape 27 connected to a lip portion 29 of the seal 21. When the trailing end of the missile 1 is offset in the launch tube 3, it pushes against the lip portion 29 of the seal 21, releasing the tension on the tension tape 27 and allowing the high pressure gas to push the plug 25 away from the branch of the Y and high pressure gas to bypass the seal 21 in the area adjacent the seal where the trailing end of the missile 1 is close to the launch tube 3 to provide a centering force on the trailing end of the missile to stabilize the in-tube trajectory of the missile.

The apparatus hereinbefore described generally affords a method of stabilizing in-tube trajectory of a missile being ejected from a launch tube and comprises the steps of:

generating a high pressure gas in a gas generator (not shown) to pressurize the launch tube;

providing an annular seal adjacent the trailing end of the missile;

delivering high pressure gas to the launch tube on the trailing end side of the annular seal to pressurize the area below the missile to eject the missile from the launch tube and bypassing high pressure gas around the annular seal to an area adjacent the annular seal only where the trailing end of the missile is close to the launch tube to provide a pressure force on the missile which acts on the missile to center the trailing end thereof in the launch tube and stabilize the in-tube trajectory of the missile.

What is claimed is:

1. A system for stabilizing in-tube trajectory of a missile being ejected from a launch tube by high pressure gas comprising:

an annular seal disposed between the missile and the launch tube and means for bypassing said seal;

said bypassing means being operable when the trailing end of the missile moves laterally toward said launch tube to only bypass high pressure gas to an area adjacent a low pressure side of said seal and where the trailing end of the missile is close to the launch tube to provide a centering force adjacent the trailing end of the missile to stabilize the in-tube trajectory of the missile.

2. A system for stabilizing in-tube trajectory of a missile being ejected from a launch tube as set forth in claim 1, wherein the means for bypassing the seal comprises a plurality of conduits in fluid communication with both sides of the seal and a valve disposed in the conduit, the valve only opening when the trailing end of the missile adjacent a particular valve is close to the launch tube.

3. A system for stabilizing in-tube trajectory of a missile being ejected from a launch tube as set forth in claim 1, wherein the means for bypassing the seal are disposed in the seal.

4. A system for stabilizing in-tube trajectory of a missile being ejected from a launch tube as set forth in claim 3, wherein the means for bypassing the seal comprises a plurality of tubes disposed in a circular array around the seal and to extend through the seal, each tube having a valve which only opens for the trailing end of the missile adjacent a particular valve is close to the launch tube.

5. A system for stabilizing in-tube trajectory of a missile being ejected from a launch tube as set forth in claim 3, wherein the means for bypassing the seal comprises a plurality of circumferential slots disposed in the seal and having a triangular-shaped cross section, the slots only opening when the trailing end of the missile adjacent a particular slot is close to the launch tube.

6. A system for stabilizing in-tube trajectory of a missile being ejected from a launch tube as set forth in claim 3, wherein the means for bypassing the seal comprises a plurality of ducts disposed in the seal and a plug which only opens the ducts when the trailing end of the missile adjacent the ducts is close to the launch tube.

7. A system for stabilizing in-tube trajectory of a missile being ejected from a launch tube as set forth in claim 6, wherein the ducts are generally Y-shaped and the plug is slidably disposed in a slot aligned with the stem of the Y to close off the branches of the Y.

8. A method for stabilizing in-tube trajectory of a missile being ejected from a launch tube comprising the steps of:

generating a high pressure gas;

providing an annular seal between the missile and the launch tube adjacent the trailing end of the missile;

delivering the high pressure gas to the launch tube on the trailing end side of the annular seal; and bypassing high pressure gas around the annular seal to the general area adjacent the low pressure side of the seal where the trailing end of the missile is closest to the launch tube to provide a centering force adjacent the trailing end of the missile to stabilize the in-tube trajectory of the missile during the launch.

* * * * *